US010897665B2

(12) United States Patent
Kao et al.

(10) Patent No.: US 10,897,665 B2
(45) Date of Patent: Jan. 19, 2021

(54) METHOD OF DECREASING THE EFFECT OF AN INTERFERENCE SOUND AND SOUND PLAYBACK DEVICE

(71) Applicant: Unlimiter MFA Co., Ltd., Eden Island (SC)

(72) Inventors: Kuo-Wei Kao, Taipei (TW); Yu-Chieh Huang, Taipei (TW); Po-Jui Wu, Taipei (TW); Kuo-Ping Yang, Taipei (TW)

(73) Assignee: PIXART IMAGING INC., Hsin-Chu County (TW)

( * ) Notice: Subject to any disclaimer, the term of this patent is extended or adjusted under 35 U.S.C. 154(b) by 0 days.

(21) Appl. No.: 16/401,124

(22) Filed: May 2, 2019

(65) Prior Publication Data

US 2020/0145748 A1 May 7, 2020

(30) Foreign Application Priority Data

Nov. 5, 2018 (TW) ..... 107139180 A

(51) Int. Cl.

| | |
|---|---|
| ***H04R 1/10*** | (2006.01) |
| ***H04R 1/08*** | (2006.01) |
| ***H04R 1/22*** | (2006.01) |
| ***H04R 25/00*** | (2006.01) |

(52) U.S. Cl.

CPC ..... *H04R 1/1083* (2013.01); *H04R 1/08* (2013.01); *H04R 1/1016* (2013.01); *H04R 1/222* (2013.01); *H04R 25/40* (2013.01); *H04R 2460/01* (2013.01)

(58) Field of Classification Search

CPC .. H04R 25/505; H04R 2225/43; H04R 3/005; G10L 2021/02166; G10L 19/0204

USPC ..... 381/94.9, 94.1, 320, 317

See application file for complete search history.

(56) References Cited

U.S. PATENT DOCUMENTS

2014/0241549 A1* 8/2014 Stachurski ..... H04M 3/568 381/92
2014/0314260 A1* 10/2014 Aubreville ..... H04R 25/407 381/313
2017/0345439 A1* 11/2017 Jensen ..... G10L 21/0232

* cited by examiner

*Primary Examiner* — Alexander Krzystan
(74) *Attorney, Agent, or Firm* — Bacon & Thomas, PLLC

(57) ABSTRACT

A method of decreasing the effect of an interference sound is disclosed and includes the following the steps: receiving an input sound by a first microphone and a second microphone to respectively acquire a first sound signal and a second sound signal; determining and acquiring a plurality of sound source position data according to a phase difference between a plurality of sound frames of at least one position low-frequency sound signal of the first sound signal and a plurality of sound frames of at least one position low-frequency sound signal of the second sound signal; determining a probability that a main direction of the input sound is in accordance with a target orientation according to each of the sound source position data; and adjusting, according to the probability, the sound volume of low-frequency sound signals of the first sound signal and the second sound signal being outputted.

16 Claims, 4 Drawing Sheets

METHOD OF DECREASING THE EFFECT OF AN INTERFERENCE SOUND AND SOUND PLAYBACK DEVICE

BACKGROUND OF THE INVENTION

1. Field of the Invention

The present invention relates to a method of decreasing the effect of an interference sound; more particularly, the present invention relates to a method of decreasing the effect of an interference sound by means of eliminating the interference sound.

2. Description of the Related Art

Early types of hearing aids were equipped with only a single microphone for picking up sounds. As a result, a hearing impaired person would always hear the same sound whether the sound was outputted from a first speaker or a second speaker. To help the hearing impaired person to experience more true-to-life sounds, current hearing aids are commonly equipped with two microphones, and the microphones are respectively located next to the left ear and the right ear of the hearing impaired person while in use.

Furthermore, some existing portable devices such as smart phones or tablet computers are equipped with two microphones, which are usually disposed respectively at the top end and the bottom end of the device and spaced a certain distance apart.

Moreover, although the arrangement of two microphones can significantly enhance the range and effect of picking up sounds, it often comes with a side effect of collecting interference sounds from the surrounding environment, which can result in unclear speech content. Therefore, an important focus of research and development of hearing aids is to eliminate or lower the volume of the interference sounds.

Therefore, there is a need to provide a method of decreasing the effect of an interference sound and a sound playback device to mitigate and/or obviate the aforementioned problems.

SUMMARY OF THE INVENTION

It is an object of the present invention to provide a method of decreasing the effect of interference sounds, and a sound playback device for executing the same.

To achieve the abovementioned objects, the method of decreasing the effect of an interference sound of the present invention is applied to a sound playback device. The sound playback device includes a first microphone and a second microphone. The method of decreasing the effect of an interference sound of the present invention comprises the following steps: receiving an input sound by the first microphone and the second microphone to respectively acquire a first sound signal and a second sound signal, wherein the first sound signal comprises at least one first localization judgement signal and the second sound signal comprises at least one second localization judgement signal, wherein both the at least one first localization judgement signal and the at least one second localization judgement signal have a selected frequency and a wavelength of the at least one first localization judgement signal and a wavelength of the at least one second sound signal are larger than a distance between the first microphone and the second microphone, and both the at least one first localization judgement signal and the at least one second localization judgement signal have a plurality of sound frames; determining a plurality of phase differences between each of the same sound frames of the first localization judgement signal and the second localization judgement signal with the same selected frequency in a predetermined frame numbers; determining and acquiring a plurality of sound source localization data according to each of the phase differences; determining a probability that a main direction of a source of the input sound is in accordance with a target orientation according to each of the sound source localization data; and adjusting, according to the probability that the main direction of the source of the input sound is in accordance with the target orientation, the sound volume of low-frequency sound signals of the first sound signal and the second sound signal being outputted.

The sound playback device of the present invention comprises a first microphone, a second microphone and a microcontroller. The first microphone is used for receiving an input sound to acquire a first sound signal, wherein the first sound signal comprises at least one first localization judgement signal. The second microphone is used for receiving the same input sound to acquire a second sound signal, wherein the second sound signal comprises at least one second localization judgement signal Both the at least one first localization judgement signal and the at least one second localization judgement signal have a selected frequency and a wavelength of the at least one first localization judgement signal and a wavelength of the at least one second sound signal are larger than a distance between the first microphone and the second microphone. Both the at least one first localization judgement signal and the at least one second localization judgement signal have a plurality of sound frames. The microcontroller is electrically connected to the first microphone and the second microphone. The microcontroller comprises a low-frequency sound signal analysis module, a computing module and a low-frequency sound signal processing module. The low-frequency sound signal analysis module is used for determining a plurality of phase differences between each of the same sound frames of the first localization judgement signal and the second localization judgement signal with the same selected frequency in a predetermined frame numbers and determining and acquiring a plurality of sound source localization data according to the phase differences. The computing module is used for determining a probability that a main direction of a source of the input sound is in accordance with a target orientation according to each of the sound source localization data. The low-frequency sound signal processing module is used for adjusting, according to the probability that the main direction of the input sound is in accordance with the target orientation, the sound volume of low-frequency sound signals of the first sound signal and the second sound signal being outputted.

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
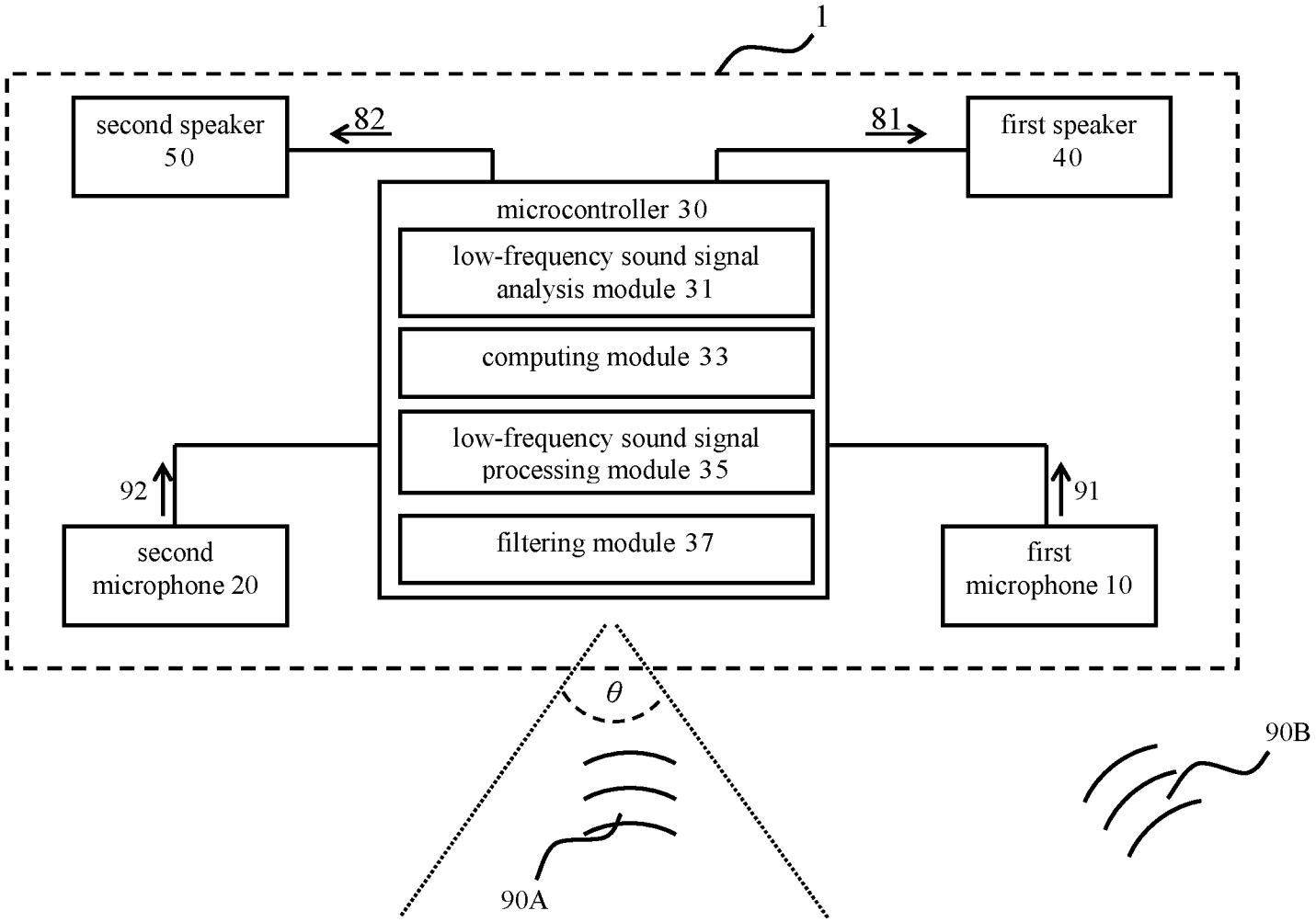
FIG. 1 illustrates a device structural drawing of a sound playback device according to the present invention.

Please refer to FIG. 1, which illustrates a device structural drawing of a sound playback device according to the present invention.

Figure 2:
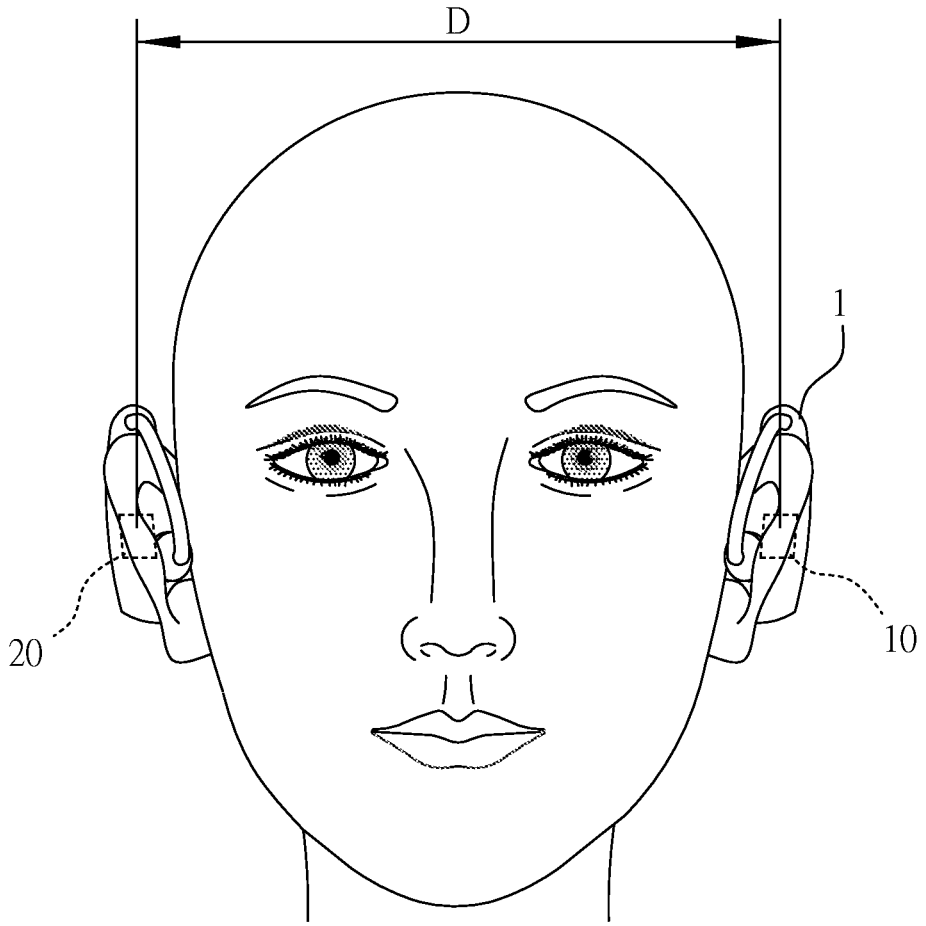
FIG. 2 illustrates a schematic drawing of the sound playback device according to one embodiment of the present invention.
Figure 3:
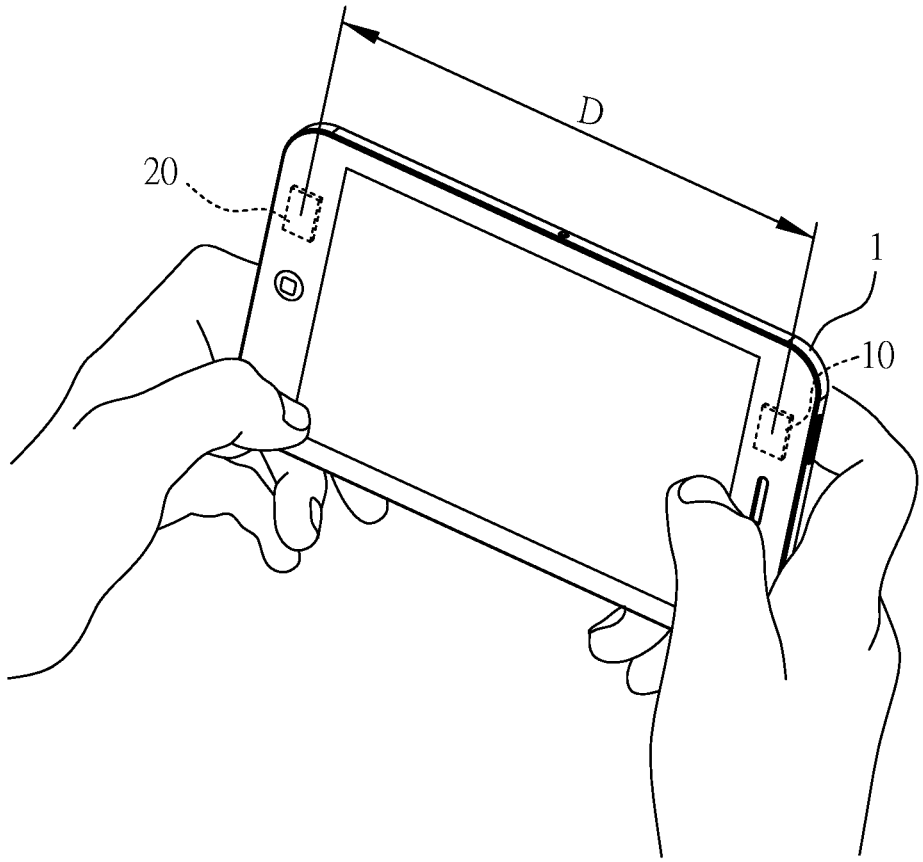
FIG. 3 illustrates a schematic drawing of the sound playback device according to another embodiment of the present invention.

As shown in FIG. 1, the sound playback device 1 of the present invention comprises a first microphone 10, a second microphone 20, a microcontroller 30, a first speaker 40 and a second speaker 50. As shown in FIG. 2, in one embodiment of the present invention, the sound playback device 1 is a hearing aid; therefore, when a user wears the hearing aid of the present invention, the first microphone 10 and the second microphone 20 will be respectively located next to the left ear and the right ear of the user. At this time, the distance D between the first microphone 10 and the second microphone 20 is around 10 to 30 centimeters, which is approximately equal to the width of a human face (or human head). As shown in FIG. 3, in another embodiment of the present invention, the sound playback device 1 is a smart phone, and the first microphone 10 and the second microphone 20 are respectively disposed at two relative ends of the smart phone at a distance D between the two ends of around 7 to 15 centimeters, depending on the length of the smart phone. Please note that the sound playback device 1 of the present invention is not limited to the abovementioned hearing aid or smart phone and that the sound playback device 1 can also be a tablet computer or other electronic device equipped with two microphones. In the event that the sound playback device 1 is a tablet computer, the distance between the first microphone 10 and the second microphone 20 is around 20 to 40 centimeters.

In one embodiment of the present invention, the first microphone 10 and the second microphone 20 can receive an input sound 90A or 90B from an external environment. After the first microphone 10 receives the input sound 90A or 90B, it will generate and acquire a first sound signal 91, wherein the first sound signal 91 comprises first localization judgement signals. After the second microphone 20 receives the input sound 90A or 90B, it will generate and acquire a second sound signal 92, wherein the second sound signal 92 comprises localization judgement signals. Each of the first localization judgement signals has a selected frequency and each of the second first localization judgement signals also has corresponding the selected frequency and a wavelength of each of the first localization judgement signals and a wavelength of each of the second localization judgement signals are larger than a distance between the first microphone 10 and the second microphone 20. The selected frequencies of the first localization judgement signals are vary and are selected between 500 Hz and 1500 Hz, and the selected frequencies of the second localization judgement signals are vary and are selected between 500 Hz and 1500 Hz. In a specific embodiment of the present invention, the selected frequencies of the first localization judgement signals and the localization judgement signals are selected from 500 Hz to 1500 Hz, but the invention is not limited to this. Each of the first localization judgement signals and each of the second localization judgement signals have a plurality of sound frames.

In one embodiment of the present invention, the microcontroller 30 is electrically connected to the first microphone 10 and the second microphone 20. The microcontroller 30 comprises a low-frequency sound signal analysis module 31, a computing module 33, a low-frequency sound signal processing module 35 and a filtering module 37. Please note that each of the abovementioned modules can be accomplished by a hardware device, a software program, a firmware or a combination thereof, and that it can also be configured in the form of a circuit loop or other suitable format. Furthermore, each of the modules can be configured either in an independent form or in a combined form. In one preferred embodiment, each module is a software program which can be stored in a memory (not shown in the figures) of the microcontroller 30 such that a processor (not shown in the figures) of the microcontroller 30 can execute each module to achieve the object of the present invention. Moreover, the embodiment disclosed herein only describes a preferred embodiment of the present invention. To avoid redundant description, not all possible variations and combinations are described in detail in this specification. However, those skilled in the art will understand that the above modules or components are not all necessary parts. Also, to implement the present invention, other more detailed known modules or components might also be included. It is possible that each module or component can be omitted or modified depending on different requirements, and it is also possible that other modules or components might be disposed between any two modules.

In one embodiment of the present invention, the first microphone 10 and the second microphone 20 can receive an input sound 90A or 90B from an external environment. After the first microphone 10 receives the input sound 90A or 90B, it will generate and acquire a first sound signal 91, wherein the first sound signal 91 comprises first localization judgement signals. After the second microphone 20 receives the input sound 90A or 90B, it will generate and acquire a second sound signal 92, wherein the second sound signal 92 comprises localization judgement signals. Each of the first localization judgement signals has a selected frequency and each of the second first localization judgement signals also has corresponding the selected frequency and a wavelength of each of the first localization judgement signals and a wavelength of each of the second localization judgement signals are larger than a distance between the first microphone 10 and the second microphone 20. The selected frequencies of the first localization judgement signals are vary and are selected between 500 Hz and 1500 Hz, and the selected frequencies of the second localization judgement signals are vary and are selected between 500 Hz and 1500 Hz. In a specific embodiment of the present invention, the selected frequencies of the first localization judgement signals and the localization judgement signals are selected from 500 Hz to 1500 Hz, but the invention is not limited to this. Each of the first localization judgement signals and each of the second localization judgement signals have a plurality of sound frames.

In one embodiment of the present invention, the low-frequency sound signal analysis module 31 is used for determining a plurality of phase differences between each of the same sound frames of the first localization judgement signal and the second localization judgement signal with the same selected frequency in a predetermined frame numbers and then determining and acquiring a plurality of sound source localization data according to each of the phase differences. In a specific embodiment of the present invention, the frequency of the position low frequency sound signal is, but not limited to, between 500 Hz and 1500 Hz. In a specific embodiment of the present invention, the frequency of the position low-frequency sound signal is, but not limited to, between 500 Hz and 1500 Hz. The process of the low-frequency sound signal analysis module 51 determining and acquiring the sound source position data will be described in more detail below; therefore, there is no need for further description in this paragraph.

In one embodiment of the present invention, the computing module 33 is used for determining a probability that a main direction of a source of the input sound 90A or 90B is in accordance with a target orientation according to each of the sound source localization data. The process of the computing module 33 determining the probability that the main direction of a source of the input sound 90A or 90B is in accordance with the target orientation will be described in more detail below; therefore, there is no need for further description in this paragraph.

In one embodiment of the present invention, the low-frequency sound signal processing module 35 is used for adjusting, according to the probability that the main direction of the source of the input sound 90A or 90B is in accordance with the target orientation, the sound volume of low-frequency sound signals of the first sound signal 91 and the second sound signal 92 being outputted. The higher the probability that the main direction of the source of the input sound 90A or 90B is in accordance with the target orientation is, the lesser the sound volume of the low-frequency sound signals of the first sound signal 91 and the second sound signal 92 being outputted is adjusted and lowered. In a specific embodiment of the present invention, the low-frequency sound signals refers to, without limiting the scope of the present invention, a sound signal with a frequency below 4000 Hz. The process of adjusting the sound volume of the sound signal according to the probability will be described in more detail below; therefore, there is no need for further description in this paragraph.

In one embodiment of the present invention, the filtering module 37 is used for recording a sound volume change of the low-frequency sound signals of the first sound signal 91 and the second sound signal 92 and performing a smoothing process. The process of performing the smoothing process on the low-frequency sound signals will be described in more detail below; therefore, there is no need for further description in this paragraph.

In one embodiment of the present invention, the first speaker 40 is used for playing back sound according to a received left output sound signal 81, wherein the first output sound signal 81 is generated by the microcontroller 30 by means of processing the first sound signal 91 and the second speaker 50 is used for playing back sound according to a received second output sound signal 82, wherein the right output sound signal 82 is generated by the microcontroller 30 by means of processing the second sound signal 92.

Figure 4:
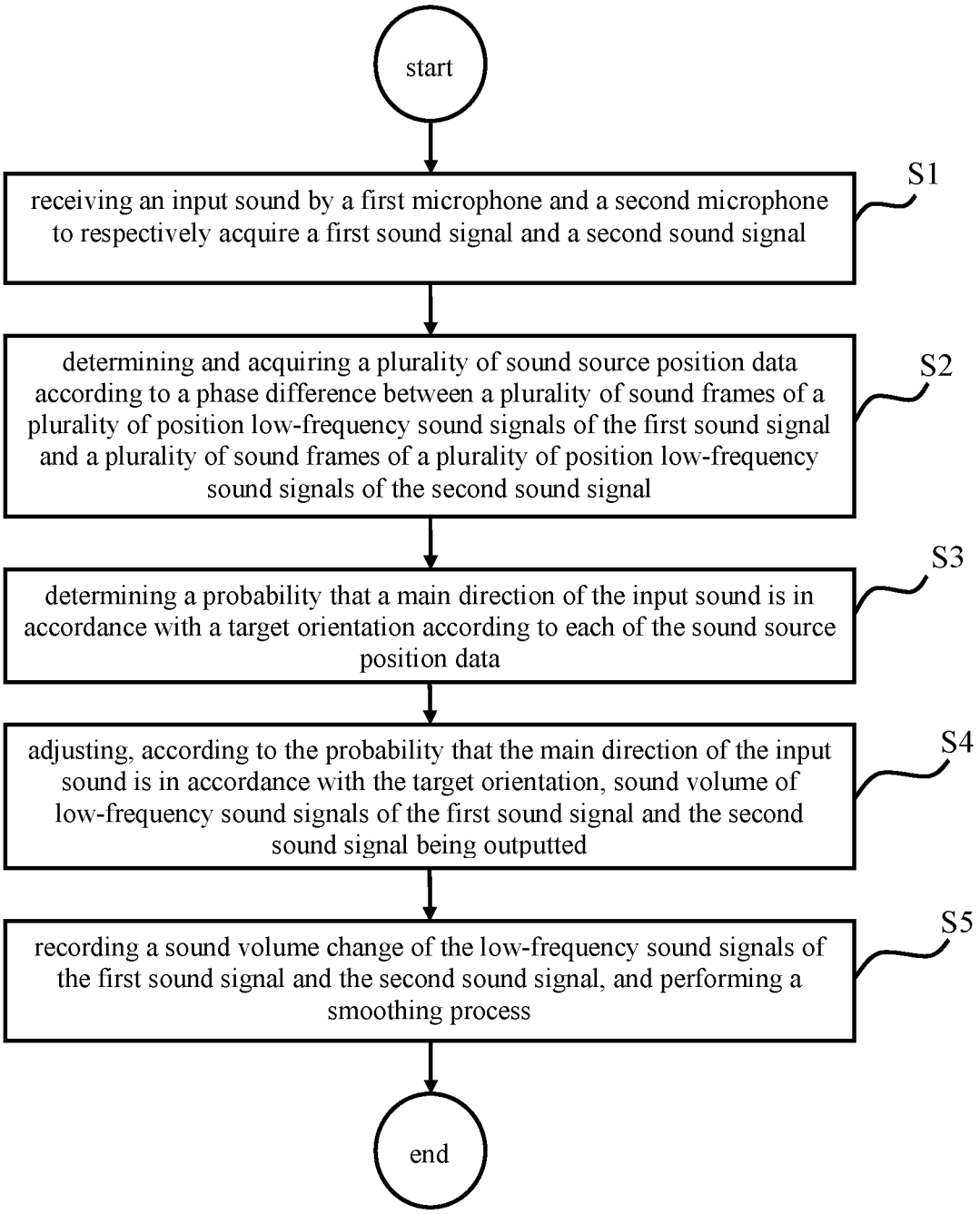
FIG. 4 illustrates a flowchart of a method of decreasing the effect of an interference sound according to the present invention.

Next, please refer to FIG. 4, which illustrates a flowchart of a method of decreasing the effect of an interference sound according to the present invention. Please note that the abovementioned sound playback device 1 is employed as an example for describing the method of decreasing the effect of an interference sound according to the present invention and also that the method disclosed in this present invention is not limited to application to the sound playback device 1 as disclosed above.

First, performing step S1: receiving an input sound 90A or 90B by a first microphone 10 and a second microphone 20 to respectively acquire a first sound signal 91 and a second sound signal 92.

When the user uses the sound playback device 1 of the present invention, the first microphone 10 and the second microphone 20 can be used to receive the input sound 90A or 90B from an external environment. After the first microphone 10 receives the input sound 90A or 90B, it will generate and acquire the first sound signal 91, wherein the first sound signal comprises first localization judgement signals. After the second microphone 20 receives the input sound 90A or 90B, it will generate and acquire the second sound signal 92, wherein the second sound signal comprises second localization judgement signals. Each of the first localization judgement signals has a selected frequency and each of the second first localization judgement signals also has corresponding the selected frequency, wherein a wavelength of each of the first localization judgement signals and a wavelength of each of the second localization judgement signals are larger than a distance between the first microphone 10 and the second microphone 20. The selected frequencies of the first localization judgement signals are vary, and the selected frequencies of the second localization judgement signals are vary. In a specific embodiment of the present invention, the selected frequencies of the first localization judgement signals and the localization judgement signals are selected from 500 Hz to 1500 Hz, but the invention is not limited to this. Each of the first localization judgement signals and each of the second localization judgement signals have a plurality of sound frames. The first sound signal 91 and the second sound signal 92 will both be transmitted to the microcontroller 30.

Performing step S2: determining a plurality of phase differences between each of the same sound frames of the first localization judgement signal and the second localization judgement signal with the same selected frequency in a predetermined frame numbers and then determining and acquiring a plurality of sound source localization data according to each of the phase differences.

When the user uses the sound playback device 1 of the present invention, the first microphone 10 and the second microphone 20 will be respectively disposed at two relative ends at a distance of L centimeters, where $7 \leq L \leq 40$. Because the time of transmitting a sound wave to the first microphone 10 and to the second microphone 20 might be different, the main direction of the source of the input sound 90A and 90B can be determined by means of comparing the phase difference between the first sound signal 91 and the second sound signal 92.

If the wavelength of the sound signal is shorter than the distance between the first microphone 10 and the second microphone 20, it will result in difficulty of determining the signals to be compared. Therefore, in this embodiment, the low-frequency sound signal analysis module 31 of the microcontroller 30 of the present invention will only use, from the first sound signal 91 and the second sound signal 92, sound signals having their frequencies within a specific range (i.e., the first localization judgement signals and the second localization judgement signals) for localization determination. In a specific embodiment of the present invention, the frequencies of the first localization judgement signals are respectively 500, 700, 900, 1100, 1300 and 1500

Hz, and the frequencies of the second localization judgement signals are respectively 500, 700, 900, 1100, 1300 and 1500 Hz.

Furthermore, to determine the source orientation of the input sound 90A or 90B more precisely, the low-frequency sound signal analysis module 31 of the microcontroller 30 of the present invention will further take samples of a plurality of sound frames of each of the first localization judgement signals and each of the second localization judgement signals; in other words, each of the first localization judgement signals and each of the second localization judgement signals have a plurality of sound frames. For example, the present invention takes samples of first ten sound frames of each of the the first localization judgement signals and each of the second localization judgement signals from the first sound signal 91 and the second sound signal 92 as determination data.

As a result, the low-frequency sound signal analysis module 31 of the microcontroller 30 of the present invention analyzes and determines whether the source of the input sound 90A or 90B originates from the target orientation according to a phase difference between the same sound frames at the same frequency of the first localization judgement signal and the second localization judgement signal so as to determine and acquire a plurality of sound source localization data according to each of the determination results. In a specific embodiment of the present invention, If the first sound frames at 500 Hz of the first localization judgement signal of the first sound signal 91 and the second localization judgement signal of the second sound signal 92 indicate that the source of the input sound 90A originates from the target orientation, the sound source localization data having a code of "1" will be acquired; furthermore, if the second sound frames at 500 Hz of the first localization judgement signal of the first sound signal 91 and the second localization judgement signal of the second sound signal 92 indicate the source of that the input sound 90B does not come from the target orientation, the sound source localization data having a code "0" will be acquired. The corresponding sound source localization data will be acquired according to the determination results by means of applying the same computation to the remaining sound frames. Likewise, the first localization judgement signals at other frequency of the first sound signal 91 and the second localization judgement signal at other frequency of the second sound signal 92 can also be used for acquiring other corresponding sound source localization data.

Generally speaking, a talker and a listener will usually face each other during a conversation; in this case, if it is determined that the main direction of the source of the input sound 90A received by the first microphone 10 and the second microphone 20 originates from the front of the user, the input sound 90A will be determined as not an interference sound; in contrast, if it is determined that the main direction of the source of the input sound 90B does not come from the front of the user, the input sound 90B will be determined as an interference sound; in contrast, if it is determined that the main direction of the input sound 90B does not come from the front of the user, the input sound 90B will be determined as an interference sound. Similarly, when a user holds a smart phone or a tablet computer to play an online game with others via the Internet, in the event that the user wants to talk to other gamers, the user will also face the smart phone or the tablet computer and talk to its screen. Therefore, in the embodiment of the present invention, the abovementioned "target orientation" refers to a sector-shaped range extending in a front direction of the user from a center point of a straight line between the first microphone 10 and the second microphone 20, under the condition that the first microphone 10 and the second microphone 20 are respectively disposed at two relative ends, wherein the inclined angle θ of the sector is 40 degrees (as shown by dotted lines of FIG. 1) without limiting the scope of the present invention. Because the technique of analyzing the orientation of the sound source by means of the phase difference between different sound signals generated from the same sound source is well known by those skilled in the art of sound processing, there is no need for further description.

Performing step S3: determining a probability that a main direction of a source of the input sound 90A or 90B is in accordance with a target orientation according to each of the sound source localization data.

After the plurality of sound source localization data are acquired in step S2, the computing module 33 of the microcontroller 30 of the present invention will determine the probability that the main direction of the source of the input sound 90A or 90B is in accordance with the target orientation according to each of the sound source localization data. In a specific embodiment of the present invention, as described above, if the plurality of sound source localization data acquired from the first ten sound frames at 500 Hz of the first localization judgement signal of the first sound signal 91 and the second localization judgement signal of the second sound signal 92 are "1, 0, 1, 1, 1, 1, 0, 1, 0, 1", the probability that the main direction of the source of the input sound 90A or 90B is in accordance with the target orientation is 70% (according to the computation of 7/10*100%). Likewise, according to the plurality of sound source localization data acquired from the first ten sound frames at other frequency bands, the respective probability that the main direction of the source of the input sound 90A or 90B is in accordance with the target orientation can also be determined, for example, as 80%, 80%, 80%, 70% and 70%, respectively. Finally, the computing module 33 will calculate an average probability of the above 6 probabilities, which is 75% (according to the computation of (70+80+80+80+70+70)/6*%) for being determined as the probability that the main direction of the source of the input sound 90A or 90B is in accordance with the target orientation.

Performing step S4: adjusting, according to the probability that the main direction of the input sound 90A or 90B is in accordance with the target orientation, the sound volume of low-frequency sound signals of the first sound signal 91 and the second sound signal 92 being outputted.

In a specific embodiment of the present invention, if the probability that the main direction of the source of the input sound 90A or 90B is in accordance with the target orientation is 75%, the low-frequency sound signal processing module 35 of the microcontroller 30 will lower by 25% the sound volume of the low-frequency sound signals of the first sound signal 91 and the second sound signal 92 being outputted. That is, the low-frequency sound signal processing module 35 will multiply an originally-outputted sound volume of the low-frequency sound signals of the first sound signal 91 and the second sound signal 92 by the determined probability so as to determine an adjusted sound volume of the low-frequency sound signals of the first sound signal 91 and the second sound signal 92. In other words, the higher the probability that the main direction of the source of the input sound 90A or 90B is in accordance with the target orientation is, the less the sound volume of the low-frequency sound signals of the first sound signal 91 and the second sound signal 92 being outputted will be adjusted and lowered. In a specific embodiment of the present invention, the low-frequency sound signal refers to a sound signal with a frequency below 4000 Hz. This means that only the sound volume of the sound signal with a frequency below 4000 Hz will possibly be adjusted. Please note that the method of adjusting the sound volume of the present invention is not limited to the above description. The sound volume can be adjusted according to different probabilities and respective definitions without limiting the method of multiplying the originally-outputted sound volume by the probability.

Performing step S5: recording a sound volume change of the low-frequency sound signals of the first sound signal and the second sound signal and performing a smoothing process.

Because a sudden drop in the sound signal at each frequency band will sound unnatural to the user, after step S4 is performed, the filtering module 37 of the microcontroller 30 of the present invention will record the sound volume change of the low-frequency sound signals of the first sound signal 91 and the second sound signal 92 and then perform a smoothing process. In a specific embodiment, the filtering module 37 can perform a smoothing process on the low-frequency sound signals according to the following formula:

$$Y(n)=Y(n)*\alpha+Y(n-1)*(1-\alpha);$$

where $0<\alpha<1$, and preferably $\alpha$ is 0.9; Y(n) refers to a current low-frequency sound signal; and Y(n−1) refers to a previous low-frequency sound signal. Because the smoothing process is a common technique used in the signal processing field and its related techniques and theories are widely published in many journals and articles, the present invention is not limited to using a particular algorithm and there is no need for further description.

According to the above description, when the method of decreasing the effect of an interference sound of the present invention is applied to a hearing aid, sounds outside of the target orientation can be eliminated or the sound volume of the sounds outside of the target orientation can be lowered such that the user of the hearing aid can more clearly hear speech from the talker. Furthermore, if the method of decreasing the effect of an interference sound of the present invention is applied to a smart phone or a tablet computer, upon usage of a smart phone during an online game session, sounds outside of the target orientation can be eliminated or the sound volume of the sounds outside of the target orientation can be lowered such that participants of the online game can more clearly hear speech from the talker.

Although the present invention has been explained in relation to its preferred embodiments, it is to be understood that many other possible modifications and variations can be made without departing from the spirit and scope of the invention as hereinafter claimed.

What is claimed is:

1. A method of decreasing the effect of an interference sound, applied to a sound playback device, the sound playback device comprising a first microphone and a second microphone, the method comprising the following steps:

receiving an input sound by the first microphone and the second microphone to respectively acquire a first sound signal and a second sound signal, wherein the first sound signal comprises at least one first localization judgement signal and the second sound signal comprises at least one second localization judgement signal and both the at least one first localization judgement signal and the at least one second localization judgement signal have a plurality of sound frames;

wherein both the at least one first localization judgement signal and the at least one second localization judgement signal have a selected frequency and a wavelength of the at least one first localization judgement signal and the wavelength of the at least one second sound signal are larger than a distance between the first microphone and the second microphone;

determining a plurality of phase differences between each of the same sound frames of the first localization judgement signal and the second localization judgement signal with the same selected frequency in a predetermined frame numbers;

determining and acquiring a plurality of sound source localization data according to each of the plurality of phase differences;

determining a probability that a main direction of a source of the input sound is in accordance with a target orientation according to each of the sound source localization data; and adjusting, according to the probability, the sound volume of low-frequency sound signals of the first sound signal and the second sound signal being outputted.

2. The method as claimed in claim 1, wherein the higher the probability is, the lesser the sound volume of the low-frequency sound signals of the first sound signal and the second sound signal being outputted is adjusted and lowered.

3. The method as claimed in claim 1, wherein the number of the at least one first localization judgement signal and the number of the at least one second localization judgement signal are plural, wherein the selected frequencies are variable and are selected between 500 Hz and 1500 Hz.

4. The method as claimed in claim 3, wherein the frequencies of the low-frequency sound signals of the first sound signal and the frequencies of the low-frequency sound signals of the second sound signal are below 4000 Hz.

5. The method as claimed claim 1, further comprising the following step:

recording a sound volume change of the low-frequency sound signals of the first sound signal and the second sound signal and performing a smoothing process.

6. The method as claimed claim 1, wherein the distance between the first microphone and the second microphone is L cm, and $7 \leq L \leq 40$.

7. The method as claimed in claim 6, wherein the sound playback device is a hearing aid system, a smart phone or a tablet computer.

8. A sound playback device, comprising:

a first microphone, used for receiving an input sound to acquire a first sound signal, wherein the first sound signal comprises at least one first localization judgement signal;

a second microphone, used for receiving the input sound to acquire a second sound signal, wherein the second sound signal comprises at least one second localization judgement signal and both the at least one first localization judgement signal and the at least one second localization judgement signal have a plurality of sound frame;

wherein both the at least one first localization judgement signal and the at least one second localization judgement signal have a selected frequency and a wavelength of the at least one first localization judgement signal and the wavelength of the at least one second sound signal are larger than a distance between the first microphone and the second microphone; and a microcontroller, electrically connected to the first microphone and the second microphone, the microcontroller comprising:

a low-frequency sound signal analysis module, used for determining a plurality of phase differences between each of the same sound frames of the first localization judgement signal and the second localization judgement signal with the same selected frequency in a predetermined frame numbers and determining and acquiring a plurality of sound source localization data according to each of the plurality of phase differences;

a computing module, used for determining a probability that a main direction of a source of the input sound is in accordance with a target orientation according to each of the sound source localization data; and a low-frequency sound signal processing module, used for adjusting, according to the probability, the sound volume of low-frequency sound signals of the first sound signal and the second sound signal being outputted.

9. The sound playback device as claimed in claim 8, wherein the higher the probability is, the lesser the sound volume of the low-frequency sound signals of the first sound signal and the second sound signal being outputted is adjusted and lowered.

10. The sound playback device as claimed in claim 8, wherein the number of the at least one first localization judgement signal and the number of the at least one second localization judgement signal are plural, wherein the selected frequencies are vary and are selected between 500 Hz and 1500 Hz.

11. The sound playback device as claimed in claim 10, wherein the frequencies of the low-frequency sound signals of the first sound signal and the frequencies of the low-frequency sound signals of the second sound signal are below 4000 Hz.

12. The sound playback device as claimed claim 8, wherein the microcontroller further comprises a filtering module, used for recording a sound volume change of the low-frequency sound signals of the first sound signal and the second sound signal and performing a smoothing process.

13. The sound playback device as claimed claim 8, wherein the distance between the first microphone and the second microphone is L cm, and $7 \leq L \leq 40$.

14. The sound playback device as claimed in claim 13, wherein the sound playback device is a hearing aid system, a smart phone or a tablet computer.

15. The method as claimed in claim 1, wherein the selected frequency is selected from 500 Hz to 1500 Hz.

16. The sound playback device as claimed in claim 8, wherein the selected frequency is selected from 500 Hz to 1500 Hz.

* * * * *